US012498170B2

(12) United States Patent
Li et al.

(10) Patent No.: US 12,498,170 B2
(45) Date of Patent: Dec. 16, 2025

(54) AIR-COOLING WATER CHILLER

(71) Applicant: SHENZHEN ENVICOOL TECHNOLOGY CO., LTD., Guangdong (CN)

(72) Inventors: Zhiming Li, Guangdong (CN); Baohui Shui, Guangdong (CN); Yaoping Qin, Guangdong (CN); Hao Wang, Guangdong (CN); Qingzhen Zeng, Guangdong (CN)

(73) Assignee: SHENZHEN ENVICOOL TECHNOLOGY CO., LTD., Guangdong (CN)

( * ) Notice: Subject to any disclaimer, the term of this patent is extended or adjusted under 35 U.S.C. 154(b) by 118 days.

(21) Appl. No.: 18/202,281

(22) Filed: May 25, 2023

(65) Prior Publication Data

US 2023/0384026 A1 Nov. 30, 2023

(30) Foreign Application Priority Data

May 25, 2022 (CN) ..... 202221270413.8

(51) Int. Cl.
*F25D 31/00* (2006.01)
*F25D 11/00* (2006.01)
*F25D 23/00* (2006.01)

(52) U.S. Cl.
CPC ..... *F25D 31/002* (2013.01); *F25D 11/00* (2013.01); *F25D 23/006* (2013.01)

(58) Field of Classification Search
CPC ..... F25D 31/002; F25D 23/006; F25D 11/00; F24F 1/20; F24F 13/20
See application file for complete search history.

(56) References Cited

U.S. PATENT DOCUMENTS 11,359,847 B2 * 6/2022 Kopko ..... F25B 23/006
2019/0383509 A1 * 12/2019 Takagi ..... F25B 49/02
(Continued)

FOREIGN PATENT DOCUMENTS

CN 202371936 U * 8/2012
CN 204063368 U * 12/2014
(Continued)

OTHER PUBLICATIONS

Translated_Yi (Year: 2020).*
(Continued)

*Primary Examiner* — Jerry-Daryl Fletcher
*Assistant Examiner* — Samba Nmn Gaye
(74) *Attorney, Agent, or Firm* — Yue (Robert) Xu; Apex Attorneys at Law, LLP

(57) ABSTRACT

An air-cooling water chiller includes a heat exchanger, a water-cooling system, and a refrigeration system. Heat is exchanged between the water-cooling system and the refrigeration system through the heat exchanger, and the refrigeration system and the water-cooling system are arranged in an up and down direction. The heat exchanger is embedded in the water-cooling system and leans towards the refrigeration system. The refrigeration system and the water-cooling system are arranged separately, so that heat dissipations of the refrigeration system and the water-cooling system do not interfere with each other, and pipelines do not intertwine with each other, making the later maintenance very convenient and simple. In addition, the refrigeration system and the water-cooling system are arranged in an up and down direction, so that an occupation area is small, making multiple systems convenient to be arranged in parallel for later.

8 Claims, 5 Drawing Sheets

(56) References Cited

U.S. PATENT DOCUMENTS

| | | | | |
|---|---|---|---|---|
| 2020/0158386 | A1* | 5/2020 | Wu | F25B 30/02 |
| 2020/0400320 | A1* | 12/2020 | Obara | F24F 13/222 |

FOREIGN PATENT DOCUMENTS

| | | | | | |
|---|---|---|---|---|---|
| CN | 210425749 | U | * | 4/2020 | |
| CN | 215372708 | U | * | 12/2021 | |
| CN | 215930032 | U | * | 3/2022 | |
| GB | 2570817 | A | * | 8/2019 | F24F 1/10 |

OTHER PUBLICATIONS

Translated_Jun (Year: 2022).*
Translated_Peng (Year: 2021).*
Translated_suito (Year: 2019).*
Translated_Wu (Year: 2012).*
Translated_Zhang (Year: 2014).*

* cited by examiner

AIR-COOLING WATER CHILLER

CROSS REFERENCE TO RELATED APPLICATIONS

The present application claims priority to Chinese Patent Application No. 202221270413.8, titled "AIR-COOLING WATER CHILLER", filed on May 25, 2022 with the China National Intellectual Property Administration, which is incorporated herein by reference in its entirety.

FIELD

The present application relates to the technical field of water chillers, and in particular to an air-cooling water chiller.

BACKGROUND

A current air-cooling water chiller product generally occupies a large area and has a relatively low height. The main reasons are layout of systems of the water chiller such as a refrigeration system, a water-cooling system, and an electrical control system, and distribution and mounting positions of larger devices in different systems. That is, the refrigeration system, the water-cooling system, and the electrical control system are distributed in a horizontal direction, and the larger devices, such as a compressor, a water pump, a plate heat exchanger, in the systems are arranged at the bottom of the water chiller.

In the water chiller, the refrigeration system, the water-cooling system and electrical control system are horizontally arranged at the bottoms of the water chiller, and the larger devices (such as the compressor, the water pump, the plate heat exchanger, etc.) in the systems are also arranged at the bottom of the water chiller, which causes a large occupation and a relatively low height of the water chiller, resulting in a waste of usable space in a height direction.

To sum up, how to effectively solve the problem of poor arrangement of internal structures of the water chiller is an urgent problem for those skilled in the art.

SUMMARY

An air-cooling water chiller is provided according to the present application, and the air-cooling water chiller can effectively solve the problem of the poor arrangement of internal structures of the water chiller.

The present disclosure provides the following technical solutions.

The air-cooling water chiller includes a heat exchanger, a water-cooling system and a refrigeration system, heat is exchanged between the water-cooling system and the refrigeration system through the heat exchanger, the refrigeration system and the water-cooling system are arranged in an up and down direction, and the heat exchanger is embedded in the water-cooling system and leans towards the refrigeration system.

In the air-cooling water chiller, the refrigeration system and the water-cooling system are arranged separately to allow heat dissipations of the refrigeration system and the water-cooling system not to interfere with each other, and pipelines thereof do not intertwine with each other, making later maintenance very convenient and simple. In addition, the refrigeration system and the water-cooling system are arranged in the up and down direction, so that an occupation area is small, making multiple systems convenient to be arranged in parallel later. Moreover, it is convenient for an air inlet and an air outlet to be arranged in the up and down direction, which is beneficial to the circulation flow by utilizing the specific gravity of the air. Therefore, in the air-cooling water chiller, the overall structure is designed reasonably, which not only ensures the convenience of assembly and maintenance, but also makes the layout compact and reduces the occupation area of the air-cooling water chiller. To sum up, the air-cooling water chiller can effectively solve the problem of the poor layout of internal structures of the water chiller.

Preferably, the air-cooling water chiller further includes a cabinet and an electrical control system, the water-cooling system is arranged in a lower part of the cabinet, and the refrigeration system is arranged in an upper part of the cabinet; an air outlet, the electrical control system, and an air inlet are sequentially arranged on a front surface of the air-cooling water chiller from top to bottom; and air entering from the air inlet can flow upwards and sequentially pass through the electrical control system and a condenser of the refrigeration system, and then flow out of the air outlet.

Preferably, a bearing seat of the electrical control system is rotatably connected to the cabinet through a vertical axis; and/or an outer partition covering an outer surface of the electrical control system is rotatably connected to the cabinet through the vertical axis.

Preferably, the electrical control system and the heat exchanger are arranged in a front and back direction with a gap between the electrical control system and the heat exchanger, the air entering from the air inlet is caused to flow upwards from the gap to the condenser of the refrigeration system.

Preferably, the air-cooling water chiller further includes two refrigeration systems, that is, a first refrigeration system and a second refrigeration system, a first condenser of the first refrigeration system is vertically arranged in the front of the water chiller, and a second condenser of the second refrigeration system is arranged tilted backwards and upwards.

Preferably, a maximum refrigeration power of the first refrigeration system is less than a maximum refrigeration power of the second refrigeration system.

Preferably, a first compressor of the first refrigeration system and a second compressor of the second refrigeration system are both arranged behind the first condenser, and connection pipes on tops of the first compressor and the second compressor are arranged wholly or partially above a top of the first condenser.

Preferably, a lower edge of the second condenser is arranged in the front of the water chiller, and an upper edge is arranged at the rear of the unit.

Preferably, the first compressor and the second compressor are respectively arranged on the left side and the right side of a cavity of the cabinet; a first electronic expansion valve of the first refrigeration system and a second electronic expansion valve of the second refrigeration system are both arranged between the first compressor and the second compressor, and directly above the heat exchanger.

Preferably, two external fans arranged in parallel are arranged in front of the first condenser, and three external fans arranged in a triangle are arranged above the second condenser.

BRIEF DESCRIPTION OF THE DRAWINGS

In order to more clearly illustrate technical solutions in the embodiments of the present disclosure or in the conventional technology, the following briefly introduces the accompanying drawings required to be used in the description of the embodiments or the conventional technology. Obviously, the accompanying drawings in the following description are only some embodiments of the present disclosure. For those skilled in the art, other drawings can be obtained based on the drawings without creative efforts.

FIG. 3 is a structural schematic diagram of an air-cooling water chiller according to an embodiment of the present disclosure when an electrical control system is turned on;

The reference signs in the attached drawings are as follows:

1 heat exchanger, 2 water-cooling system, 3 refrigeration system, 4 cabinet, 5 electrical control system, 6 air outlet, 7 air inlet, 8 external fan, 9 outer partition, 10 lateral air outlet, 31 first condenser, 32 second condenser, 33 first compressor, 34 second compressor, 35 first electronic expansion valve, 36 second electronic expansion valve, and 51 bearing seat.

DETAILED DESCRIPTION OF EMBODIMENTS

An air-cooling water chiller according to embodiments of the present disclosure effectively solves the problem of the poor layout of internal structures of the unit.

Technical solutions in the embodiments of the present disclosure are clearly and completely described below in conjunction with the accompanying drawings in the embodiments of the present disclosure. Obviously, the described embodiments are only a part of the embodiments of the present disclosure, not all of them. Based on the embodiments in the present disclosure, all other embodiments obtained by those skilled in the art without creative efforts fall within the protection scope of the present disclosure.

Figure 1:
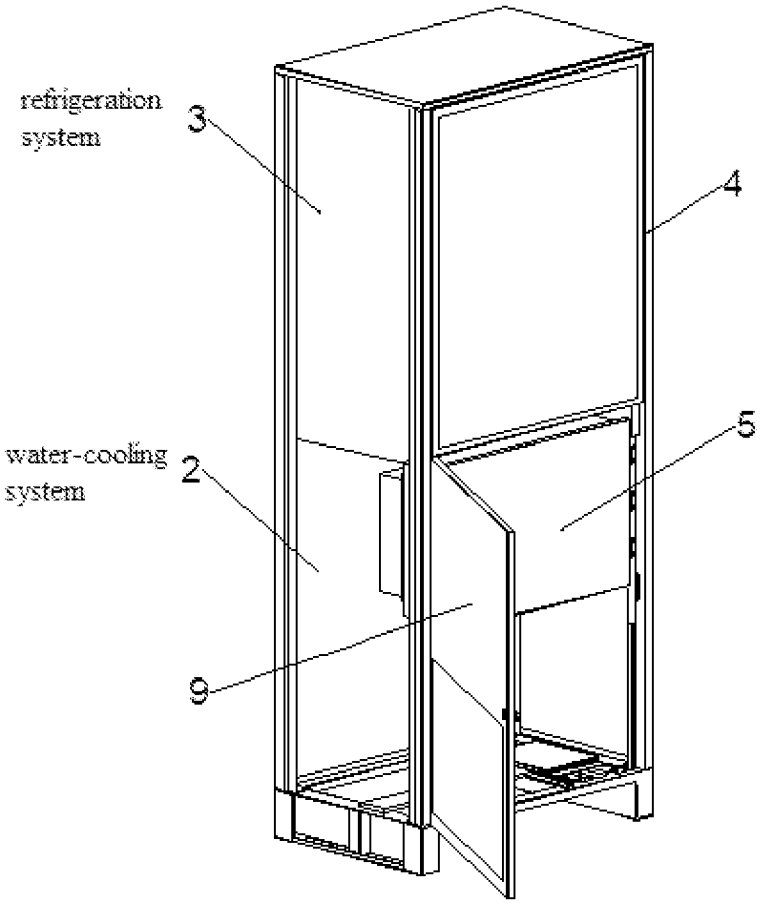
FIG. 1 is a structural schematic diagram of an air-cooling water chiller according to an embodiment of the present disclosure when a front cabinet door is partially opened.
Figure 2:
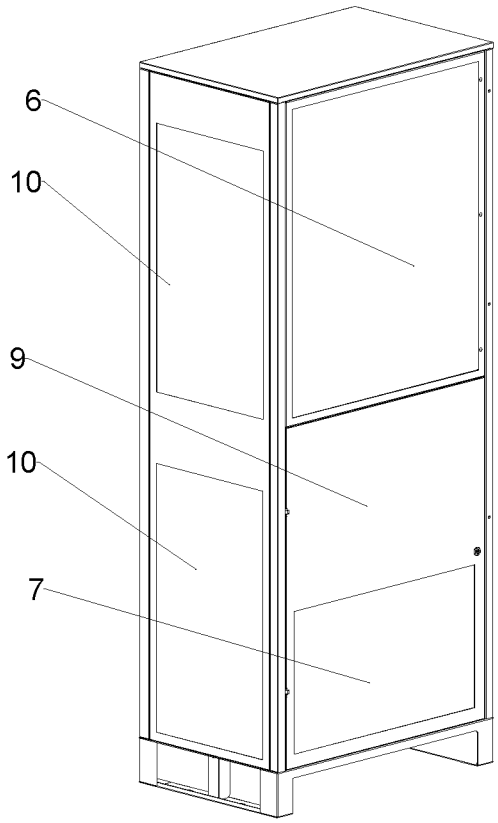
FIG. 2 is a structural schematic diagram of a lateral-front direction of an air-cooling water chiller according to an embodiment of the present disclosure.
Figure 3:
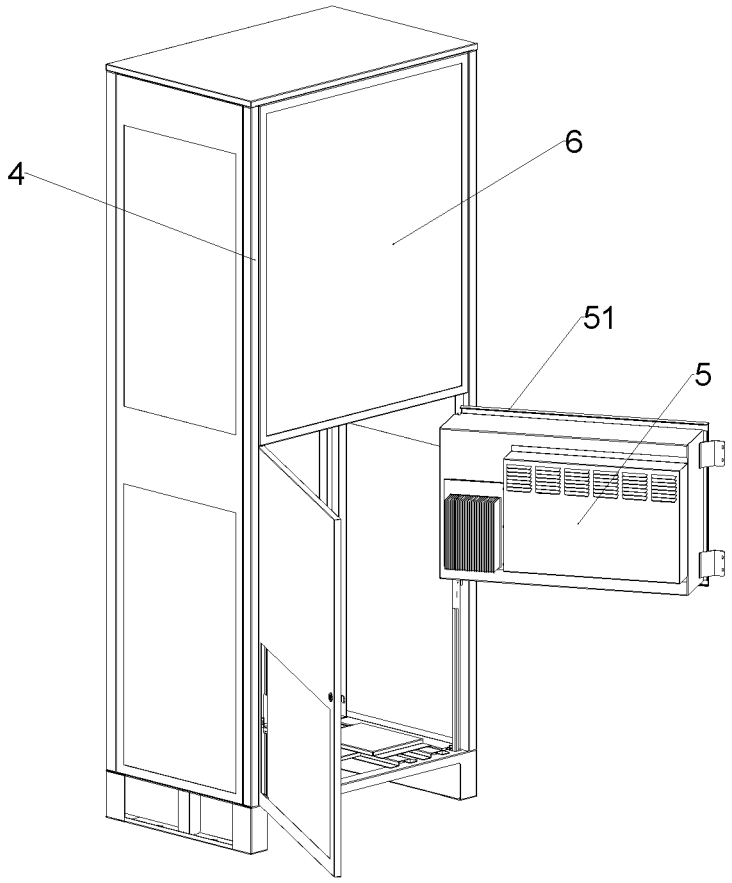
Figure 4:
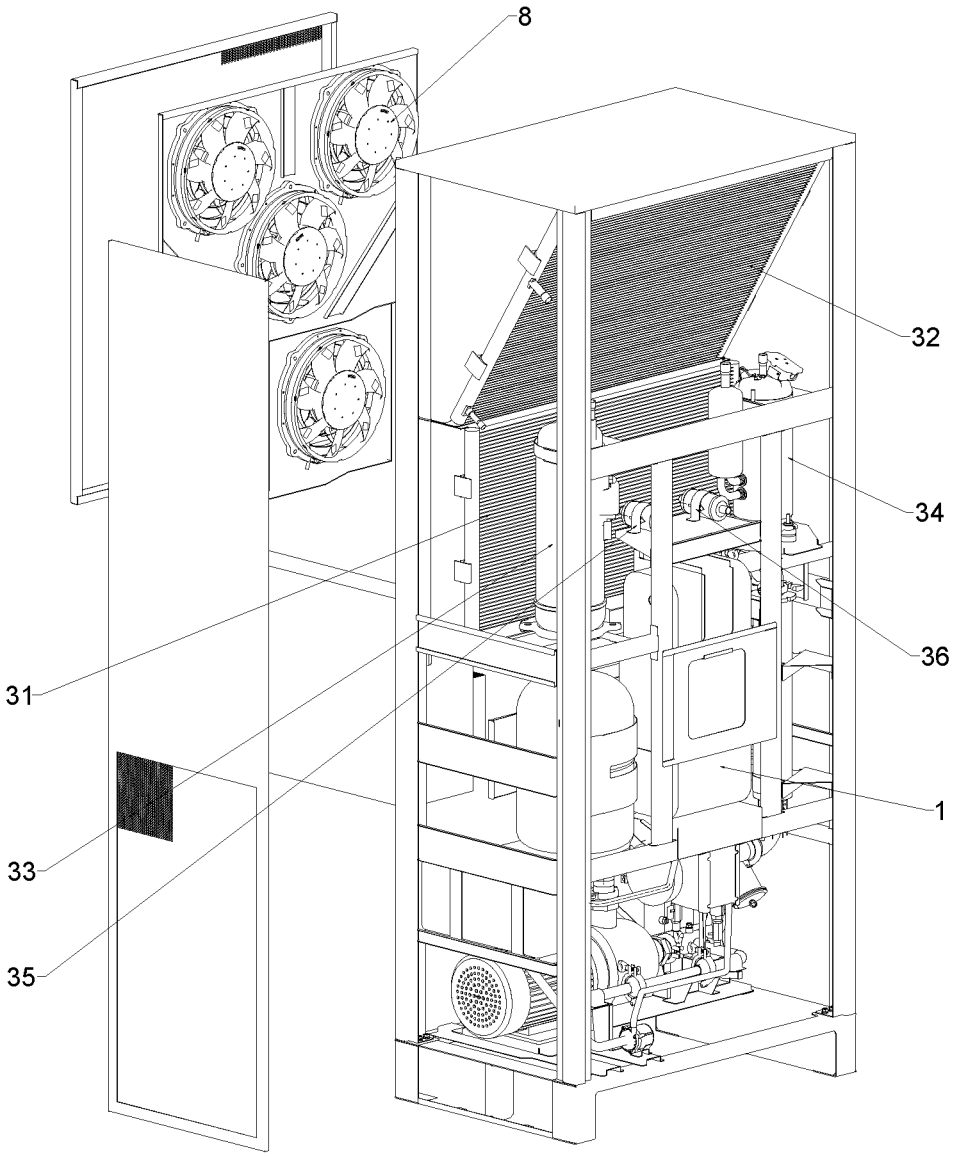
FIG. 4 is a exploded view of a local structure of an air-cooling water chiller according to an embodiment of the present disclosure.
Figure 5:
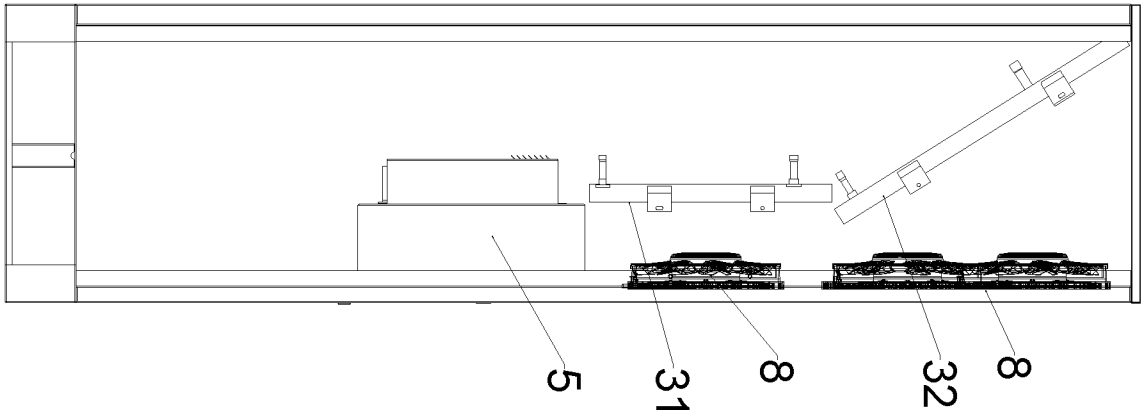
FIG. 5 is a schematic diagram of an internal local layout of a side of the air-cooling water chiller according to an embodiment of the present disclosure.

Referring to FIGS. 1 to 5, FIG. 1 is a structural schematic diagram of an air-cooling water chiller according to an embodiment of the present disclosure when a front cabinet door is partially opened; FIG. 2 is a structural schematic diagram of a lateral-front direction of an air-cooling water chiller according to an embodiment of the present disclosure; FIG. 3 is a structural schematic diagram of an air-cooling water chiller according to an embodiment of the present disclosure when an electrical control system is turned on; FIG. 4 is an exploded view of a local structure of an air-cooling water chiller according to an embodiment of the present disclosure; and FIG. 5 is a schematic diagram of an internal local layout of a side of the air-cooling water chiller according to an embodiment of the present disclosure.

As shown in FIG. 1, an air-cooling water chiller is provided in some embodiments. The air-cooling water chiller includes a heat exchanger 1, a water-cooling system 2 and a refrigeration system 3. Heat is exchanged between the water-cooling system 2 and the refrigeration system 3 through the heat exchanger 1, that is, a water-cooling channel and a condensation channel are arranged in the heat exchanger 1. The water-cooling channel is connected to the water-cooling system 2, and the condensation channel is connected to the refrigeration system 3. A plate heat exchanger is generally used as the heat exchanger 1. Certainly, a cylinder heat exchanger or other heat exchangers may also be used. The water chiller generally may also include an electrical control system.

The refrigeration system 3 and the water-cooling system 2 are arranged in an up and down direction. The water-cooling system 2 may be arranged above the refrigeration system 3, or the water-cooling system 2 may be arranged below the refrigeration system 3. The heat exchanger 1 is embedded in the water-cooling system 2 and leans towards the refrigeration system 3, so that the heat exchanger 1 is lower than the refrigeration system 3, which is not only results in a compact arrangement, but also facilitates the connection of internal pipelines.

In the air-cooling water chiller, the refrigeration system 3 and the water-cooling system 2 are arranged separately to ensure that heat dissipations of the refrigeration system 3 and the water-cooling system 2 do not interfere with each other, and pipelines do not intertwine with each other, making later maintenance very convenient and simple. In addition, the refrigeration system 3 and the water-cooling system 2 are arranged in the up and down direction, so that an occupation area is small, which makes multiple systems convenient to be arranged in parallel later. Moreover, it is convenient for an air inlet 7 and an air outlet 6 to be arranged in the up and down direction, which is beneficial to the circulation flow by utilizing the specific gravity of air. Therefore, in the air-cooling water chiller, the overall structure is designed reasonably, which not only ensures the convenience of assembly and maintenance, but also makes the layout compact and reduces the occupation area of the unit. To sum up, the air-cooling water chiller can effectively solve the problem of the poor layout of internal structures of the unit.

In some embodiments, in a case that the air-cooling water chiller is further provided with a cabinet 4 and an electrical control system 5, the water-cooling system 2 is arranged in a lower part of the cabinet 4, and the refrigeration system 3 is arranged in an upper part of the cabinet 4. If necessary, they also may be arranged upside down.

The water-cooling system 2 is arranged in the lower part of cabinet 4, and the refrigeration system 3 is arranged in the upper part of the cabinet, which facilitates dissipating heat of the cooling system 3 in the upper part of the cabinet 4. An air outlet 6 corresponding to a condenser of the refrigeration system 3 may be arranged on the upper front side of the cabinet 4, and an air inlet 7 corresponding to the condenser of the refrigeration system 3 may be arranged on the lower front side of the cabinet 4, so that air enters from the upper part and exits from the lower part, the heated air can rise as soon as possible to avoid the air inlet.

In some examples, the air outlet 6, the electrical control system 5 and the air inlet 7 are sequentially arranged on a front side of the water chiller from top to bottom, so that the electrical control system 5 can be exposed at the front side of the water chiller to facilitate maintenance of the electrical system. The air entering from the air inlet 7 can flow upwards and sequentially pass through the electrical control system 5 and the condenser of the refrigeration system 3, and then flow out of the air outlet 6, so that the air entering from the air inlet 7 can dissipate heat from the electrical control system 5. Since the heat that is required to be dissipated from the electrical control system 5 is not much, the air entering from the air inlet can still flow upwards after absorbing heat from the electrical control system 5, so as to enter the condenser of the refrigeration system 3 for heat dissipation. Through the above arrangement, a good heat dissipation effect can be achieved on the electrical control system 5 to ensure an efficient operation of the entire machine.

In the air-cooling water chiller provided in some embodiments, the air outlet 6, the electrical control system 5 and air inlet 7 are sequentially arranged at the front side of the water chiller from top to bottom. The air entering from the air inlet 7 can flow upwards and sequentially pass through the electrical control system 5 and the condenser of the refrigeration system 3, and then flow out of the air outlet 6. There is no requirement for arranging positions of the refrigeration system 3, the water-cooling system 2 and so on. For example, reference may be made to the above arrangement. The refrigeration system 3 and the water-cooling system 2 may also be arranged left and right in parallel, front and back in parallel, or crossed.

In some embodiments, the electrical control system 5 may be arranged at the front side of the water chiller, and position relationships of the air outlet 6 and the air inlet 7 relative to the electrical control system 5 may not be limited. For example, reference may be made to the above arrangement. The air outlet 6 and the air inlet 7 may also be arranged above the electrical control system 5 or below the electrical control system 5, or at least one of the air inlet 7 and the air outlet 6 is not arranged or neither is arranged at the front side of the water chiller. The electrical control system 5 is arranged at the front side of the water chiller, which can greatly facilitate the maintenance of the electrical control system 5.

In some embodiments, on the basis of any one of the above embodiments, a bearing seat 51 of the electrical control system 5 may also be rotatably connected to the cabinet 4 through a vertical axis, so that the electrical control system 5 can be opened by turning left or right, facilitating the exposure of the internal structure of the electrical control system 5. Specifically, the electrical control system 5 may further include an outer partition 9, and the outer partition 9 covers the electrical control system 5. The outer partition 9 is rotatably connected to the cabinet 4 through the vertical axis. When the outer partition 9 is opened, the electrical control system 5 is exposed. In this case, the wiring and so on of the electrical control system 5 may be at the outer side of the electrical control system 5 or at the inner side of the electrical control system 5. Based on the above considerations, the bearing seat 51 and the outer partition 9 may be rotatably connected to the cabinet 4 simultaneously through the vertical axis, as shown in FIG. 3. The hinge shaft of the bearing seat 51 is at one side of the left and right direction of the cabinet, and the hinge shaft of the outer partition 9 is on the other side of the left and right direction of the cabinet to be opened in the opposite direction. The rotatable connection with the cabinet 4 may be a rotatable connection with the support column at the corner of the cabinet 4. For example, the rotatable connection may be a rotatable connection through a hinge. An orifice plate with an air inlet may also be fixed with the outer partition 9, such as by integral molding, to facilitate opening the orifice plate and the outer partition 9 together, so that the water-cooling system is effectively exposed when opened, so as to facilitate the maintenance of the water-cooling system. Correspondingly, an upper cabinet door is arranged on the upper part of the front side of the water chiller, and an air outlet 6 is arranged on the upper cabinet door. The upper cabinet door is rotatably connected to the cabinet 4 to fully expose an external fan 8 when the upper cabinet door is opened.

Further, in order to facilitate the rapid flow of the air entering from the air inlet 7 to the condenser, the electrical control system 5 and the heat exchanger 1 may be arranged front and back with a gap between the electrical control system 5 and the heat exchanger 1, so that the air entering from the air inlet 7 flows upwards from the gap to the condenser of the refrigeration system 3. By arranging the gap between electrical control system 5 and the heat exchanger 1, not only is the flow speed of the air greatly improved, but also heat can be effectively dissipated from the electrical control system 5. In some embodiments, air guiding channels may also be arranged in other places, and only a part of the air entering from the air inlet 7 is required to pass through the electrical control system 5.

In some examples, an air inlet 7 is arranged on the front side of the cabinet 4. The air inlet 7 may only be arranged at the front side of the cabinet 4, or the air inlet 7 may be arranged on one of a left side panel and a right side panel of the cabinet 4, or simultaneously on the left side panel and the right side panel of the cabinet 4.

One or two refrigeration systems may be arranged in the water chiller. Specifically, in some embodiments, the water chiller includes two refrigeration systems 3, and one or more water-cooling systems 2 and one or more electrical control systems 5 may be arranged. The water chiller may include two refrigeration systems 3 based on the above embodiments.

Two refrigeration systems include a first refrigeration system and a second refrigeration system. A first condenser 31 of the first refrigeration system is vertically arranged at the front of the water chiller, and a second condenser 32 of the second refrigeration system is tilted backwards and upwards. A certain gap is arranged between the front side of the first condenser 31 and a front panel of the cabinet 4 for arranging the external fan 8. In other embodiments, the first condenser 31 and the second condenser 32 may be arranged in the up and down direction in parallel, in the left and right direction in parallel, or in other ways.

By arranging the first condenser 31 in the front of the water chiller and the second condenser 32 tilted upwards, it not only is beneficial for the external fan to exhaust air forward, but also can effectively increase the space for arranging the second condenser 32, allowing for the use of the second condenser 32 with a larger area. Moreover, by the tilted arrangement, some space can also be left below the second condenser 32 to facilitate arranging other components.

In some embodiments, preferably, a maximum refrigeration power of the first refrigeration system is less than a maximum refrigeration power of the second refrigeration system. That is, the second condenser 32 with the tilted arrangement may be a high-power condenser, so as to be better applicable to two refrigeration systems with different powers which are activated according to different demands. In order to further increase the area of the second condenser 32, preferably, a lower edge of the second condenser is arranged at the front side of the water chiller, and an upper edge of the second condenser is arranged at the rear side of the water chiller. The tilt angle may be arranged according to air-out requirements. A large tilt angle leads to a compact structure and a poor air-out effect. On the contrary, a small tilt angle leads to a good air-out effect and a poor compact structure. Specifically, in practical applications, an appropriate tilt angle may be jointly determined according to the requirements of the air-out effect and the compact structure.

Generally, the tilt angle may be correspondingly arranged between 30 degrees and 60 degrees, preferably 45 degrees.

Generally, in a case that the maximum refrigeration power of the first condenser 31 is less than the maximum refrigeration power of the second condenser 32, the number of external fan 8 used at the second condenser 32 is greater than the number of external fan 8 used at the first condenser 31, or the power of the former is greater than that of the latter.

In some embodiments, a first compressor 33 of the first refrigeration system and a second compressor 34 of the second refrigeration system may be arranged behind the first condenser 31, and may further be arranged directly below the second condenser 32. Connection pipes on tops of the first compressor 33 and the second compressor 34 are arranged wholly or partially above a top of the first condenser 31, so that some space adjacent to the underside of the second condenser 32 may be utilized to make the structure more compact.

In some embodiments, the first compressor 33 and the second compressor 34 are respectively arranged on the left side and the right side of a cavity of the cabinet. A first electronic expansion valve 35 of the first refrigeration system and a second electronic expansion valve 36 of the second refrigeration system are arranged between the first compressor 33 and the second compressor 34, and directly above the heat exchanger 1, so as to facilitate the connection of pipes from the first electronic expansion valve 35 and the second electronic expansion valve 36 to the heat exchanger 1, and reduce lengths of the pipes and make the overall structure more compact. Further, in order to facilitate the connection of the heat exchanger 1, a first condensation channel connector and a second condensation channel connector may be respectively arranged on the left side and the right side of the heat exchanger 1. A first condensation channel is connected to the corresponding first electronic expansion valve 35, and a second condensation channel is connected to the corresponding second electronic expansion valve 36.

In some embodiments, the refrigeration system 3 and the water-cooling system 2 are arranged in the up and down direction, that is, the refrigeration system 3 is arranged in the upper part of the water chiller. In a case that two refrigeration systems 3 are arranged, both of the refrigeration systems 3 are arranged in the upper part of the water chiller, and the water-cooling system 2 is arranged in the lower part of the water chiller. The electrical control system 5 may be arranged at a same height as the top of the water-cooling system 2, that is, roughly in the middle of the water chiller. In this case, the refrigeration systems 3 and the water-cooling system 2 may be arranged adjacent to each other, the water-cooling system 2 and the electrical control system 5 are arranged horizontally in parallel or arranged in an embedded manner. Specifically, the electrical control system 5 may be hung in the middle front part of the water chiller, which may be connected by screws. In order to facilitate opening for maintenance, the electrical control system 5 may be hung in the middle front part of the water chiller through a hinge.

In some embodiments, the refrigeration system 3 generally includes an external fan 8, a condenser, a compressor, a plate heat exchanger, an electronic expansion valve and a refrigerant filter. If two refrigeration systems are arranged, the two refrigeration systems may share a plate heat exchanger. In this case, the plate heat exchanger has two condensation channels to be connected to the two refrigeration systems respectively. In the case that two refrigeration systems are arranged, i.e. a first refrigeration system and a second refrigeration system. For the convenience of description, the first refrigeration system includes a first external fan, a first condenser 31, a first compressor 33, a first electronic expansion valve 35 and a first refrigerant filter; and the second refrigeration system includes a second external fan, a second condenser 32, a second compressor 34, a second electronic expansion valve 36 and a second refrigerant filter.

In some embodiments, the water-cooling system generally includes a water pipe electric heater, an expansion tank, a water filter, a water pump, a make-up water tank, an air collecting tank and a make-up water pump. The plate heat exchanger has a water-cooling channel to communicate with the water-cooling system, and the water-cooling channel and the condensation channel are arranged for heat exchange, so that they can conduct heat with each other. Correspondingly, in a case that two condensation channels are arranged, the two condensation channels are in contact with the water-cooling channel for heat exchange.

In the above embodiments, the overall structure is designed reasonably. The reasonable structure design ensures the convenience of assembly and maintenance. The compact layouts reduce the occupation areas of the water chiller. Arranging the electrical control system in the middle front part of the water chiller can expose the electronic control system well, which facilitates the maintenance of the electronic control system. The overall layout of the devices is reasonable. It ensures the rationality of the connection and the use of various devices in the water chiller (i.e., the water-cooling system is arranged in the lower part of the water chiller, and the refrigeration system is arranged in the upper part of the water chiller). The devices with short maintenance cycles can be arranged in operable positions on the front of the water chiller, facilitating the maintenance of the devices and reducing maintenance directions of the water chiller, that is, the devices can be maintained solely from the front of the water chiller.

Special structure designs, such as connecting and assembling the electronic control box system as a whole with a hinge, make the electronic control box system be opened and closed as a whole, and increases the maintainable space inside the water chiller.

It is convenient for modular design. For example, the refrigeration system and the water-cooling system are formed as modules separately, and the two modules are combined during assembly, which can improve production efficiency.

Some of the above layouts also have the effect of easy maintenance. The devices that are easy to be damaged are arranged in the front. An order of the maintenance is: electrical control system>water-cooling system>external fan>refrigeration system.

The various embodiments in the description are described in a progressive manner, and each of the embodiments focuses on the differences from other embodiments. For same or similar parts of the embodiments, reference may be made to each other.

The above description of the disclosed embodiments enables those skilled in the art to implement or use the present disclosure. Various modifications to the embodiments are apparent to those skilled in the art, and the general principles defined herein may be implemented in other embodiments without departing from the spirit or scope of the present disclosure. Therefore, the present disclosure is not limited to the embodiments shown herein, and conforms to the widest scope consistent with the principles and novel features disclosed herein.

The invention claimed is:

1. An air-cooling water chiller, comprising a heat exchanger, a water-cooling system, and two refrigeration systems, wherein heat is exchanged between the water-cooling system and the two refrigeration systems through the heat exchanger, the two refrigeration systems and the water-cooling system are arranged in an up and down direction, and the heat exchanger is located in the water-cooling system and towards the two refrigeration systems, wherein the two refrigeration systems are a first refrigeration system and a second refrigeration system, a first condenser of the first refrigeration system is vertically arranged in the front of the water chiller, and a second condenser of the second refrigeration system is tilted backwards and upwards, wherein a first compressor of the first refrigeration system and a second compressor of the second refrigeration system are both arranged behind the first condenser, wherein the first compressor and the second compressor are respectively arranged on a left side and a right side of a cavity of the cabinet; a first electronic expansion valve of the first refrigeration system and a second electronic expansion valve of the second refrigeration system are both arranged between the first compressor and the second compressor, and directly above the heat exchanger.

2. The air-cooling water chiller according to claim 1, further comprising a cabinet and an electrical controller, wherein the water-cooling system is arranged in a lower part of the cabinet, and the two refrigeration systems are arranged in an upper part of the cabinet; an air outlet, the electrical controller, and an air inlet are sequentially arranged at a front side of the water chiller from top to bottom; and air entering from the air inlet flows upwards and sequentially passes through the electrical controller and a condenser of the two refrigeration systems, and then flows out from the air outlet.

3. The air-cooling water chiller according to claim 2, wherein a bearing seat of the electrical controller is rotatably connected to the cabinet through a vertical axis.

4. The air-cooling water chiller according to claim 2, wherein an outer partition covering an outer surface of the electrical controller is rotatably connected to the cabinet through a vertical axis.

5. The air-cooling water chiller according to claim 2, wherein a bearing seat of the electrical controller is rotatably connected to the cabinet through a vertical axis; and an outer partition covering an outer surface of the electrical controller is rotatably connected to the cabinet through a vertical axis.

6. The air-cooling water chiller according to claim 1, wherein a refrigeration power of the first refrigeration system is less than a refrigeration power of the second refrigeration system.

7. The air-cooling water chiller according to claim 1, wherein a lower edge of the second condenser is arranged at the front of the water chiller, and an upper edge is arranged at the rear of the water chiller.

8. The air-cooling water chiller according to claim 1, wherein two external fans arranged in parallel are arranged in front of the first condenser, and three external fans arranged in a triangle are arranged above the second condenser.

* * * * *